US006513534B1

(12) United States Patent
Sofer et al.

(10) Patent No.: US 6,513,534 B1
(45) Date of Patent: Feb. 4, 2003

(54) HAIR DYE DISPENSER

(75) Inventors: Menachem Sofer, Ramle (IL); Roni Schneider, Tel Aviv (IL)

(73) Assignee: Montec Products Development Ltd., Ramat Hasharon (IL)

( * ) Notice: Subject to any disclaimer, the term of this patent is extended or adjusted under 35 U.S.C. 154(b) by 0 days.

(21) Appl. No.: 09/403,792

(22) PCT Filed: Nov. 10, 1998

(86) PCT No.: PCT/IL98/00546

§ 371 (c)(1),
(2), (4) Date: Oct. 27, 1999

(87) PCT Pub. No.: WO00/27240

PCT Pub. Date: May 18, 2000

(51) Int. Cl.[7] ..... A45D 24/22
(52) U.S. Cl. ..... 132/112; 132/116; 401/28
(58) Field of Search ..... 132/112, 111, 132/113, 114, 115, 116, 120, 313, 207, 208; 401/28, 290, 282, 268; 222/192, 402.2, 402.13

(56) References Cited

U.S. PATENT DOCUMENTS 1,607,674 A * 11/1926 Ives ..... 132/114
2,279,708 A 4/1942 Jakob et al.
3,457,928 A 7/1969 Kurshenoff
3,850,180 A 11/1974 Ryckman, Jr. et al.
4,143,667 A * 3/1979 Pellet ..... 401/28
4,592,376 A 6/1986 Sigmund et al.
4,858,600 A * 8/1989 Gross et al. ..... 601/159
4,958,647 A 9/1990 Busch et al.
5,059,050 A 10/1991 Guglielmo
5,297,882 A 3/1994 Kornides
5,333,627 A 8/1994 Mehringer et al.
5,443,321 A 8/1995 Dolan et al.
5,472,456 A 12/1995 Larsky et al.

FOREIGN PATENT DOCUMENTS

DE 27 49 074 2/1979

* cited by examiner

*Primary Examiner*—Pedro Philogene
(74) *Attorney, Agent, or Firm*—Mark M. Friedman

(57) ABSTRACT

A hair dye dispenser 10 for dispensing a fluid hair dye includes a dispensing container 12 for containing and dispensing the hair dye. The dispensing container 12 has a base 14 and at least one side wall 16, together defining an internal volume. The base 14 has a substantially flat upper surface and a lower surface with a plurality of projecting tines 24. One or more dispensing apertures 26 are distributed across the base 14. A piston 28 is configured to fit closely in sliding abutment with the wall 16 so as to be sealingly slidable towards the base 14. The dispenser 10 also includes a housing 30 formed with a socket 32 for removably receiving the dispensing container 12. An actuation mechanism 34 is associated with the housing 30, and configured to displace the piston 28 towards the base 14, thereby dispensing the hair dye through the dispensing apertures 26.

20 Claims, 9 Drawing Sheets

HAIR DYE DISPENSER

FIELD AND BACKGROUND OF THE INVENTION

The present invention relates to devices for dying hair in general, and in particular, to a portable hair dye dispenser which employs a removable cartridge to contain and dispense the dye.

It is known to provide a comb or brush-like device for manual application of hair dye. Examples of such devices are disclosed in U.S. Pat. No. 3,457,928 to Kurshenoff, U.S. Pat. No. 4,592,376 to Sigmond et al. and U.S. Pat. No. 5,297,882 to Kornides. Each of these devices includes a squeezable reservoir containing hair dye. Pressure applied manually to the reservoir is intended to force the dye along a conduit to a brush-like dispenser where it is released onto the hair.

Squeeze-action devices of this type suffer from a number of disadvantages. Firstly, the pressure which can be comfortably applied by the hand is generally not sufficient to force hair dyes which are typically quite viscous along the conduit and out through the dispensing openings. Even if the dye can be dispensed in this way, the rate of dispensing is typically irregular, varying with the instantaneous amount of pressure applied. Furthermore, a high level of coordination and expertise is required to apply and spread the dye while squeezing hard on the container. Finally, the reservoir and conduit have a relatively large "dead space" from which dye cannot be expelled by squeezing. This leads to wastage of a large amount of the dye, and renders the devices difficult to clean.

An alternative approach is suggested by U.S. Pat. No. 5,333,627 to Mehringer. Mehringer provides a syringe-type device in which a plunger is advanced by a finger-operated lever. The plunger forces dye towards an expulsion base which is formed with a number of dispensing channels. A removable dispenser head with a brush or sponge spreading device is mounted on the expulsion base so as to align with the dispensing channels.

The device of Mehringer offers a partial solution to some of the aforementioned problems, providing more controllable dispensing and less wastage than the squeeze-action devices described above. However, the device is still awkward to use, requiring simultaneous finger operation of the lever and spreading movement through the hair. This awkward operation is further aggravated by the long structure of the syringe body which must be held sticking outwards from the head throughout use of the device, plus the single straight row of dispensing channels which requires careful alignment of the device perpendicular to the spreading direction. Additionally, the channels of the integral expulsion base of the Mehringer device are difficult to clean and are therefore prone to becoming clogged with dye left over from previous use of the device.

There is therefore a need for a compact and easy to use hair dye dispenser which employs a replaceable cartridge to contain and dispense the dye, thereby minimizing wastage and minimizing cleaning.

SUMMARY OF THE INVENTION

The present invention is a hair dye dispenser which employs a removable cartridge to contain and dispense the dye.

According to the teachings of the present invention there is provided, a hair dye dispenser for dispensing a fluid hair dye, the dispenser comprising: (a) a dispensing container for containing and dispensing the hair dye, the dispensing container having a base and at least one side wall sealingly attached to or integrally formed with the base so as to define an internal volume of the dispensing container, the base being formed with an upper surface which is substantially flat and with a lower surface which is formed with a plurality of projecting tines, at least one dispensing aperture being formed through the base; (b) a piston configured to fit closely in sliding abutment with the at least one side wall so as to be sealingly slidable towards the base; (c) a housing formed with a socket, the socket being configured for removably receiving the dispensing container; and (d) an actuation mechanism associated with the housing, the actuation mechanism being configured to displace the piston towards the base, thereby dispensing the hair dye through the at least one dispensing aperture.

According to a further feature of the present invention, the actuation mechanism includes a conversion mechanism for converting a unidirectional rotational input to a reciprocating linear displacement, the conversion mechanism being configured such that, for a given rate of rotation of the rotational input, a speed of the reciprocating linear displacement is asymmetric, motion in a first direction being at least one order of magnitude slower than motion in an opposite direction.

According to a further feature of the present invention, the conversion mechanism includes a ratchet-toothed collar, and a tracer collar mounted coaxially with, and rotatable relative to, the ratchet-toothed collar such that relative rotation of the tracer collar relative to the ratchet-toothed collar generates the asymmetric reciprocating linear movement in an axial direction. The ratchet-toothed collar preferably features at least three ratchet teeth. The tracer collar preferably features ratchet-teeth so as to complement the ratchet-toothed collar.

According to a further feature of the present invention, the actuation mechanism further includes an electric motor connected so as to provide the rotational input.

According to a further feature of the present invention, the actuation mechanism further includes a sensor deployed to provide an end-of-cycle output indicative of the conversion mechanism reaching a predefined point in the cycle of the reciprocating linear displacement, the actuation mechanism being responsive to the end-of-cycle output to interrupt operation of the motor.

According to a further feature of the present invention, there is also provided a storage container configured for storing at least one component of the hair dye in a sealed manner, the storage container being configured for removable attachment to the dispensing container in a manner to allow release of the at least one component from the storage container into the dispensing container.

There is also provided according to the teachings of the present invention, a hair dye dispenser for dispensing a fluid hair dye, the dispenser comprising: (a) a dispensing container for containing and dispensing the hair dye, the dispensing container having a base and at least one side wall sealingly attached to or integrally formed with the base so as to define an internal volume of the dispensing container, the base being formed with an upper surface which is substantially flat and with a lower surface which is formed with a plurality of projecting tines, at least one dispensing aperture being formed through the base; (b) a piston configured to fit closely in sliding abutment with the at least one side wall so as to be sealingly slidable towards the base; and (c) an actuation mechanism associated with the dispensing container and the housing, the actuation mechanism being configured to displace the piston towards the base, thereby dispensing the hair dye through the at least one dispensing aperture, wherein the actuation mechanism includes a conversion mechanism for converting a unidirectional rotational input to a reciprocating linear displacement, the conversion mechanism being configured such that, for a given rate of rotation of the rotational input, a speed of the reciprocating linear displacement is asymmetric, motion in a first direction being at least one order of magnitude slower than motion in an opposite direction.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a hair dye dispenser.

The principles and operation of a hair dye dispenser according to the present invention may be better understood with reference to the drawings and the accompanying description.

Figure 1:
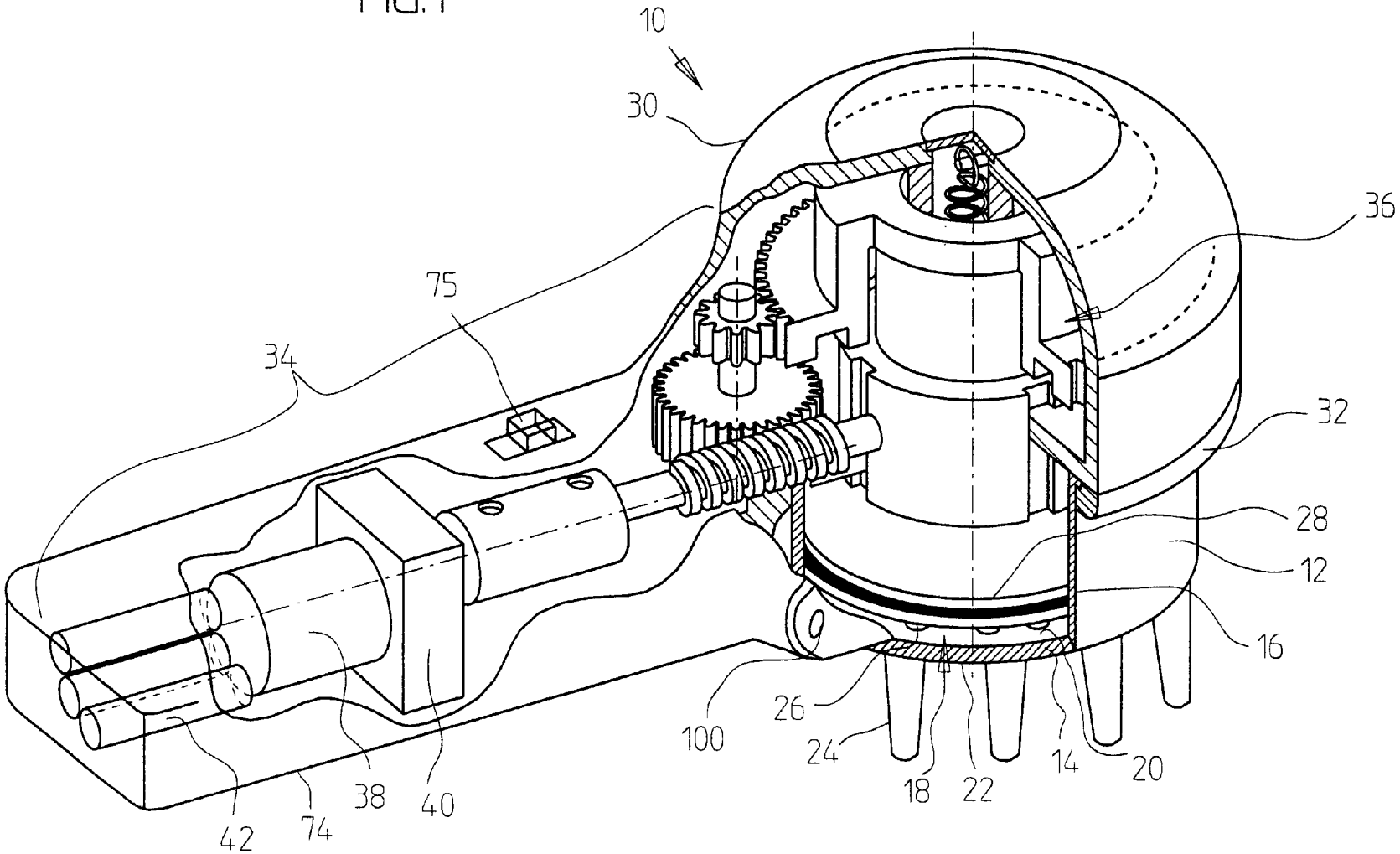
FIG. 1 is a partially cut-away isometric view of a hair dye dispenser, constructed and operative according to the teachings of the present invention.
Figure 2:
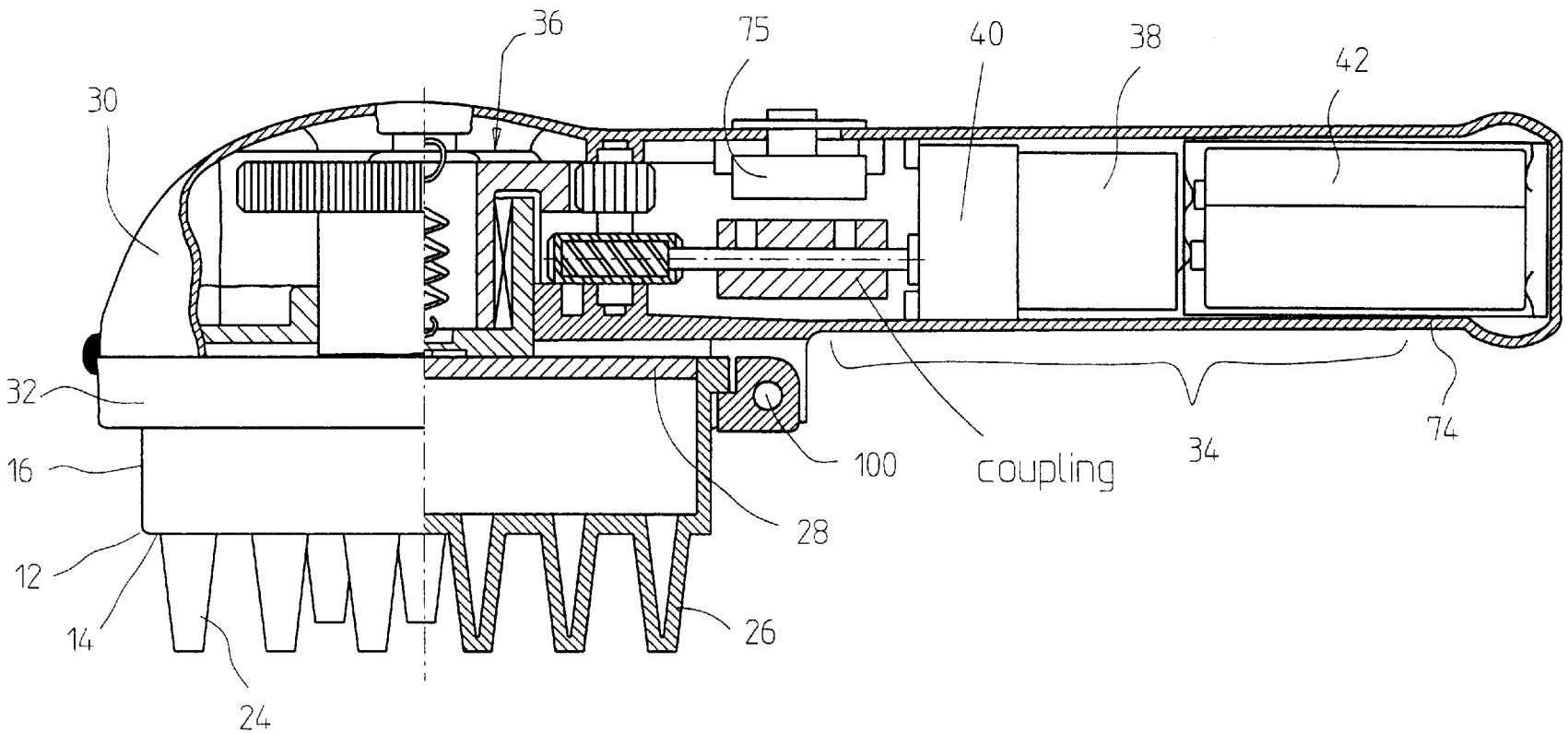
FIG. 2 is a partially cut-away side view of a hair dye dispenser of FIG. 1.

Referring now to the drawings, FIGS. 1 and 2 show a hair dye dispenser, generally designated 10, constructed and operative according to the teachings of the present invention, for dispensing a fluid hair dye.

Generally speaking, hair dye dispenser 10 includes a dispensing container 12 for containing and dispensing the hair dye. Dispensing container 12 has a base 14 sealingly attached to or integrally formed with at least one side wall 16 so as to define an internal volume 18 of dispensing container 12. Base 14 is formed with an upper surface 20 which is substantially flat and with a lower surface 22 which is formed with a plurality of projecting tines 24. A number of dispensing apertures 26 are formed through base 14 at positions distributed across the base. A piston 28 is configured to fit closely in sliding abutment with the inner surface of wall 16 so as to be sealingly slidable towards base 14.

Dispenser 10 also includes a housing 30 formed with a socket 32 configured for removably receiving dispensing container 12. Housing 30 contains an actuation mechanism 34 configured to displace piston 28 towards base 14, thereby dispensing the hair dye through dispensing apertures 26.

It will be readily apparent that the use of a replaceable dispensing container 12 received by housing 30 overcomes many problems associated with the known devices described above. Since dispensing container 12 is preferably a single-use disposable item, dispensing apertures 26 will not generally become clogged, nor will they need to be cleaned after use. At the same time, since internal volume 18 is immediately adjacent to dispensing apertures, wastage of the hair dye is minimized. Typically, piston 28 is also a disposable item, although an implementation with piston 28 attached to actuation mechanism 34 is also possible.

Also, as will become clear from the description below, preferred embodiments of dispenser 10 are implemented as a portable, lightweight device which can easily be gripped and operated by the user without excessive tiring of the user's hand, preferably without requiring coupling by cables or tubes to any external equipment. The device is preferably actuated by a light-weight electric motor built-in within housing 30, avoiding excessive weight and broad dimensions that tire the user's hand. The device provides full control over the amount of dye applied without requiring awkward manual pumping actions or the like.

Before turning to the features of the present invention in more detail, it should be appreciated that the present invention is useful in a wide range of applications in which a fluid is applied to the hair for coloring, tinting, bleaching or any other treatment. By way of example, the invention will be described in the context of applying hair dye. However, the reference to "dye" is not to be construed to limit the claimed structure in any way.

It should noted that the term "fluid" is used herein in the description and claims to refer to any composition or mixture which flows such that it can be dispensed through dispensing apertures 26 under applied pressure. Examples of fluids according to this definition include, but are not limited to, liquids, suspensions, gels, creams and pastes or a wide range of thicknesses.

Turning now to the features of dispenser 10 in more detail, it is a particular feature of most preferred implementations of dispenser 10 that actuation mechanism 34 includes a conversion mechanism 36 for converting a unidirectional rotational input to a reciprocating linear displacement. This linear displacement is used to drive piston 28 so as to dispense the hair dye. The unidirectional rotational input is preferably provided by an electric motor 38, typically reduced by a gear mechanism 40, although manually actuated implementations also fall within the scope of the present invention.

Motor 38 is typically powered by one or more battery 42, which may be of disposable or rechargeable type. Additionally, or alternatively, a connection (not shown) may be provided for use of an external power supply.

Gear mechanism 40 preferably provides a reduction ratio of at least about 100:1, and preferably at least about 1000:1. Most preferred implementations provide a ratio in excess of about 10,000:1, and typically of the order of $10^5$: 1. The high ratio ensures that a compact general purpose electric motor may be used to provide sufficient pressure to dispense even quite thick dye compositions. The exact ratio is chosen to provide a cycle of about 4–6 minutes for a given speed of motor 38.

Gear mechanism 40 may be implemented as an independent mechanism connected to a free-standing motor 38. Alternatively, part or all of gear mechanism 40 may be combined into a single unit with the motor, supplemented where necessary by a supplementary gear mechanism. In either case, the gear ratio referred to herein is the total overall ratio between the rate of rotation of the motor itself and the final stage of rotational movement before conversion to linear motion.

It will be apparent that many different mechanisms could be used for conversion mechanism 36. In a most preferred embodiment, conversion mechanism 36 is configured to generate an asymmetric rate of linear displacement such that, for a given rate of rotation of the rotational input, motion in a first direction is at least one order of magnitude slower than motion in an opposite direction. This provides a slow, high pressure drive stroke for dispensing the hair dye followed by a faster return stroke to prepare the dispenser for subsequent operation. It should be noted that this feature may also be used to advantage in alternative implementations of the present invention employing a fixed, reusable dispensing container.

One particular preferred implementation of conversion mechanism 36 will now be described with particular reference to FIGS. 3 and 4A–4D. In this case, conversion mechanism 36 includes a ratchet-toothed collar 44 and a tracer collar 46, mounted coaxially so as to be rotatable relative to each other. Rotation of tracer collar 46 relative to ratchet-toothed collar 44 generates the asymmetric reciprocating linear movement in an axial direction.

The principle of this mechanism will be most clearly understood with reference to FIGS. 4A–4D. Ratchet-toothed collar 44 features a number of ratchet-teeth 48 extending axially. Preferably, at three teeth 48 are used, providing mechanical stability of the mechanism at all stages of its movement, as will become clear. In this context, the phrase "ratchet-tooth" is used to refer to an asymmetric projection which is formed between two substantially straight or, more precisely in the case of a collar, helical edges. The extremities of the teeth are preferably rounded to facilitate smooth progression of the tracer collar between the edges of the teeth.

Tracer collar 46 is formed with features configured for following the ratchet-toothed contour of ratchet-toothed collar 44. Optionally, bearings, rollers or relatively small contact portions could be used. However, in a preferred implementation shown here, tracer collar 46 features ratchet-teeth 50 formed to complement those of ratchet-toothed collar 44.

Figure 4A:
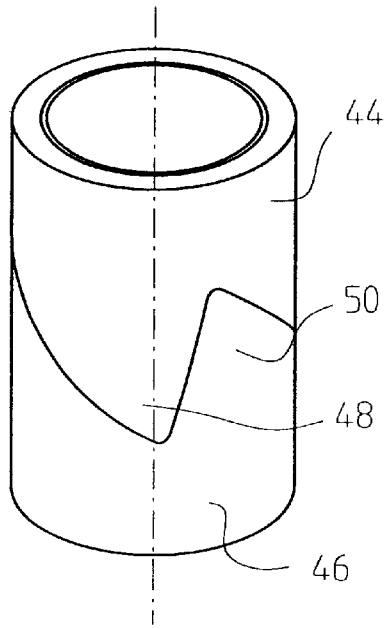
FIGS. 4A–4D are a sequence of schematic isometric views illustrating the principle of operation of the conversion mechanism of FIG. 3.
Figure 4D:
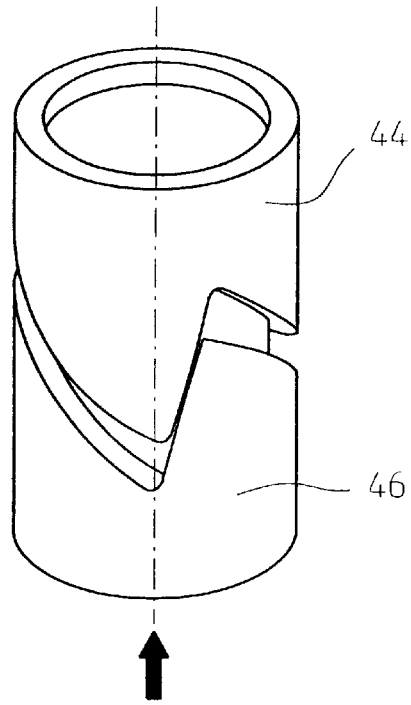
Figure 4B:
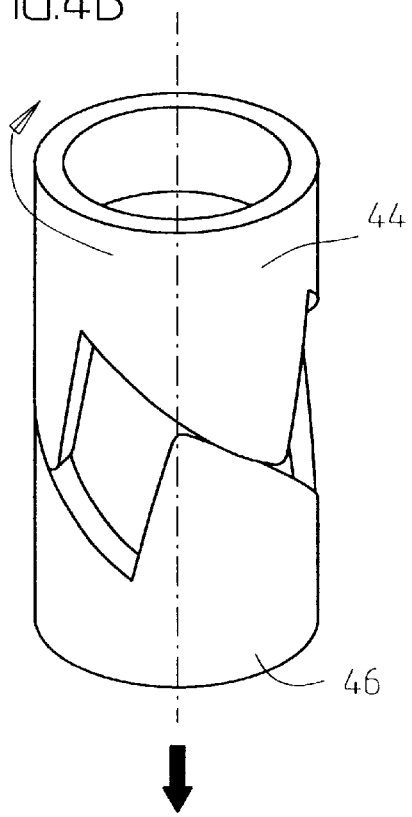

In the case shown here, ratchet-toothed collar 44 rotates while being fixed against axial movement while tracer collar 46 is fixed against rotation but axially displaceable. FIG. 4A shows a state in which ratchet-toothed collar 44 and tracer collar 46 mate to assume a fully retracted position, corresponding to the initial and final position of each cycle of operation. As ratchet-toothed collar 44 starts to turn, the less steeply inclined face of each ratchet tooth 48 slides over the corresponding surface of a ratchet tooth 50, thereby forcing tracer collar 46 axially downwards as shown in FIG. 4B.

Figure 4C:
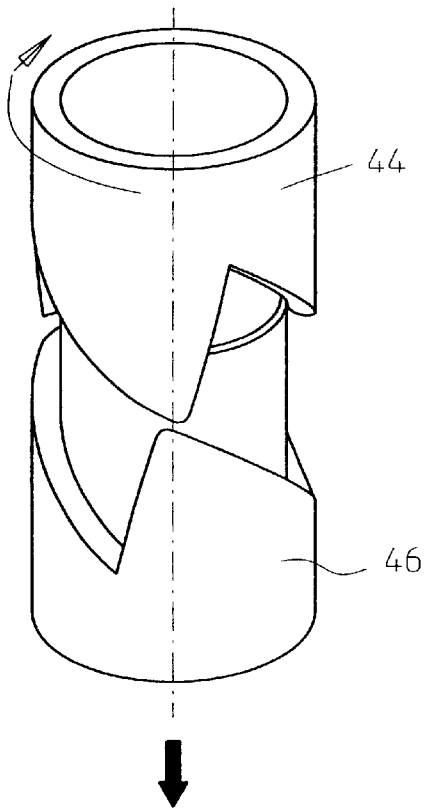

As the motion continues, the mechanism approaches the extreme of its linear motion as shown in FIG. 4C where teeth 48 and 50 contact near their extremities. It is this state that the preferred implementation with three teeth to each ring provides significant advantages of stability. Then, as the rotation of ratchet-toothed collar 44 proceeds, contact is transferred to the steeper return surfaces of teeth 48 and 50, providing a relatively rapid axial return stroke of tracer collar 46 as shown in FIG. 4D until the mechanism returns to the state of FIG. 4A with ratchet-toothed collar 44 turned through 120°. It should be noted that the steeper return surfaces of teeth 48 and 50 may approach vertical, i.e., parallel to the axis of rotation, to provide instant spring actuated return to the initial position. However, an angle of one or a few degrees avoids a percussive click of the returning tracer collar.

Figure 3:
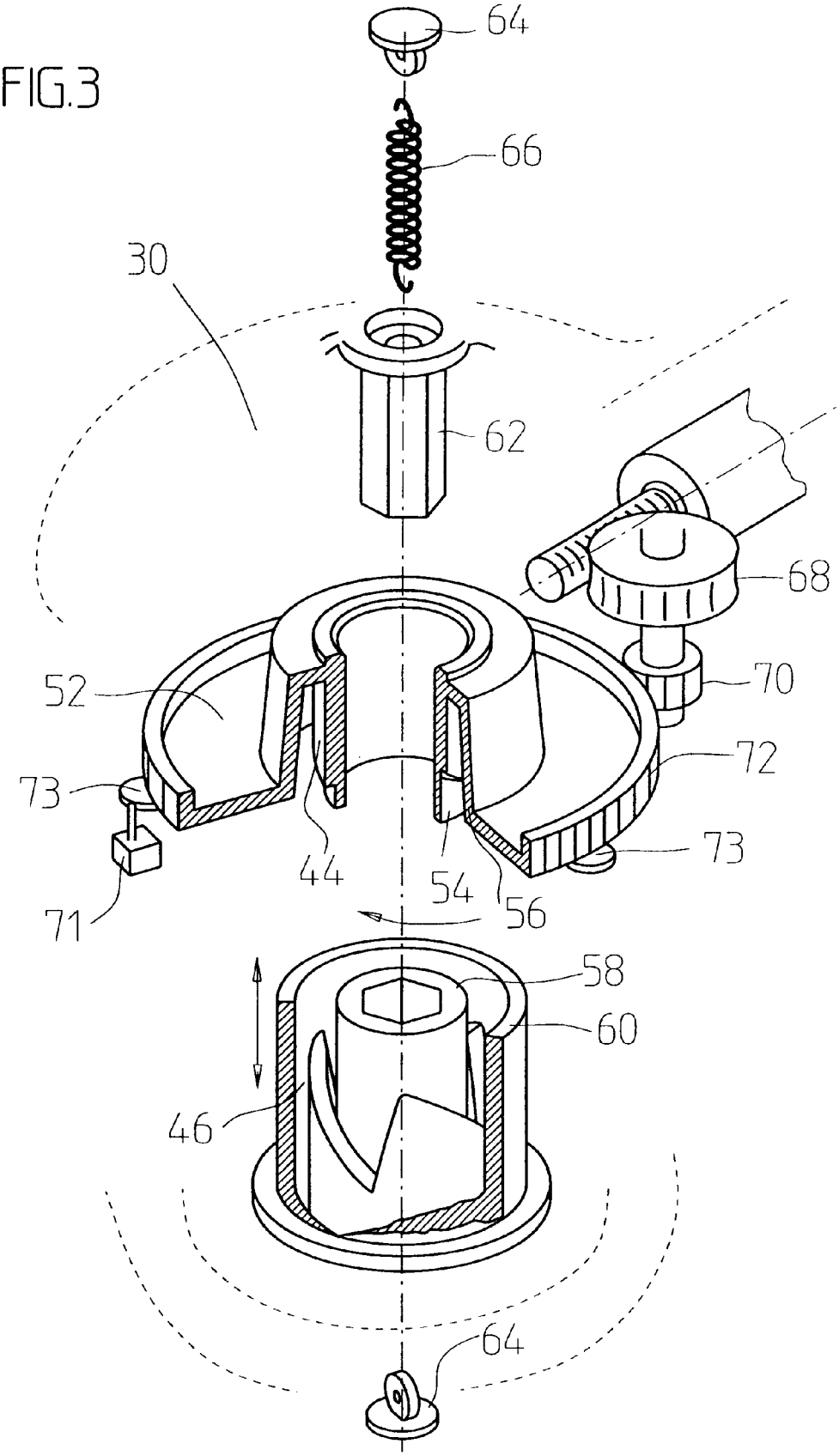
FIG. 3 is an exploded, partially cut-away, isometric view of a conversion mechanism from the hair dye dispenser of FIG. 1, configured for converting a unidirectional rotational input to a reciprocating linear displacement.

In the practical implementation of the mechanism shown in FIG. 3, axial alignment of ratchet-toothed collar 44 and tracer collar 46 is maintained by engagement of concentric cylindrical sleeves. Specifically, ratchet-toothed collar 44 is here integrally formed as part of a drive disc 52 which features an inner cylindrical sleeve 54 and an outer sleeve 56. These abut, respectively, and inner cylinder 58 and an outer cylindrical sleeve 60 integrally formed with tracer collar 46. A shaped axial pin 62, in this case of hexagonal cross-section, is rigidly attached to, or integrally formed with housing 30. Pin 62 engages a corresponding axial opening in inner cylinder 58 so as to lock the tracer collar unit against rotation while leaving it free to move axially. The mechanism is unified by a pair of retaining plugs 64 between which is stretched a spring element 66. Spring element 66 additionally assists the return motion of the tracer collar unit.

Actuation of conversion mechanism 36 is typically achieved either directly, or through an additional step-down gear 68, from gear mechanism 40 by a gear wheel 70 engaging a toothed track 72 around drive disc 52.

Actuation mechanism 34 also preferably includes features for automatically interrupting operation of the dispenser at the end of each cycle of use. To this end, a sensor 71 is deployed to provide an end-of-cycle output indicative of conversion mechanism 36 reaching a predefined point in its cycle of reciprocating linear displacement. In the example illustrated here, sensor 71 is implemented as a microswitch configured to generate a momentary reset signal when coming into contact with one of three trigger projections 73 formed on drive disc 52. This actuation mechanism is preferably configured so that this reset signal causes on/off switch 75 to return to its "off" position, thereby interrupting operation of motor 38.

Referring now briefly back to FIGS. 1 and 2, it should be noted that the described implementations of dispenser 10 allow the use of a particularly ergonomic and practical form of housing 30. Specifically, housing 30 is preferably formed with a handle 74 configured to be held in a hand of a user. An internal volume of the handle is preferably used to advantage to house most or all of actuation mechanism 34. Centralization of the weight of the actuation mechanism within the handle serves to optimize the balance and comfort of the dispenser.

Another particular advantage of certain preferred implementations of the dispenser is that socket 32 is configured to define an inserted position of dispensing container 12 as shown in which base 14 is substantially parallel to the direction of elongation of handle 74. This allows the dispenser to be held in a manner similar to a conventional hair brush during use, thereby rendering the use of dispenser 10 comfortable for self-application by a non-professional user.

Additional features contributing to the convenience and efficiency of dispenser 10 relate to the design of dispensing container 12. Firstly, the dimensions of dispensing container 12 are preferably chosen such that the dye can be dispensed over a relatively large area simultaneously, while minimizing the height dimension so that dispenser 10 can be kept as compact as possible. To this end, a major dimension of the base designated "length" is preferably at least about twice the "height" defined as the dimension of side wall 16 measured perpendicular to the length. In a preferred implementation in which base 14 is round and side wall 16 is correspondingly a single substantially cylindrical wall, the "length" will correspond to the internal diameter of wall 16.

Other features of dispensing container 12 further contributing to the ease of use and efficiency of dispenser 10 relate to the positioning and configuration of dispensing apertures 26. Preferably, at least one, and typically all, of dispensing apertures 26 are implemented as dispensing channels along the length of projecting tines 24. This ensures effective delivery of the hair dye down to the root portion of the hair where it is typically most needed. A further particularly preferred feature is that dispensing apertures 26 are distributed substantially around the periphery of base 14, and most preferably, substantially evenly spaced around a substantially circular line. With at least 6, and preferably between about 8 and about 20, dispensing apertures, this renders the distribution of dye roughly uniform over the area swept through by dispenser 10 independent of the direction in which the dispenser is moved. As a result, the user does not need to be particular about the angle at which the dispenser is held relative to the direction of brushing in the dye.

Parenthetically, it should be noted that dispensing container 12 need not assume a symmetrical cylindrical form. Examples of other possible shapes of base 14 include, but are not limited to, elliptical, square, rectangular and other regular or irregular polygonal shapes. Furthermore, although side wall(s) 16 are typically perpendicular to base 14, this is not a necessary condition. Similarly, for different applications and types of hair, the design, spacing and number of dispensing apertures may be varied considerably. By way of example, one alternative aperture design employs a single elongated slit along a major part of base 14 to dispense the dye.

Turning now to FIGS. 5A–5G and 6A–6D, it should be noted that the fluids to be dispensed by the dispenser of the present invention are frequently mixed from two or more components which must be stored separately and combined shortly before use. The disposable dispensing container 12 of the present invention may readily be filled with a ready-to-use composition prepared externally by conventional techniques. However, in a preferred implementation of the present invention, dispensing container 12 is used together with a suitably configured storage container to provide separate storage and convenient mixing of components immediately prior to use.

Turning first to FIGS. 5A–5G, these show a storage container 80 configured for storing at least one component 82 of the hair dye in a sealed manner. Storage container 80 is configured for removable attachment, typically by complementary screw-fit threading, to dispensing container 12 in a manner to allow release of the at least one component into dispensing container 12. This release is preferably achieved by provision of a breakable barrier 84 to facilitate release of the at least one component from storage container 80 into dispensing container 12. Breakable barrier may be implemented as a metal foil layer pre-scored with tear lines. The material for the barrier is chosen according to the properties of the material to be stored, in some cases requiring use of a silver coating or the like.

Optionally, a second component of the composition may be stored until use within dispensing container 12, itself. In this case, the upper opening of dispensing container 12 is sealed by the presence of storage container 80 while dispensing apertures 26 are preferably sealed externally by a peal-off adhesive sheet 86 or the like.

Alternatively, in a preferred implementation, storage container 80 has a connection port 88, normally sealed by a screw-on cap 90 or the like (FIG. 5A), which is configured to receive a storage bottle 92 (FIG. 5B) for mixing of the hair dye components. This provides a particularly convenient and clean option in which two or more components can be mixed in situ within storage container 80 before the ready-to-use composition is released into dispensing container 12.

For certain dye compositions, mixing through shaking is not fully effective such that a direct-contact stirring motion is preferable or even required. To address this requirement, certain preferred implementations of the present invention further feature a mixer element 94 associated with storage container 80. Mixer element 94 has a handle portion 96, which is preferably detachable, extending from the exterior of storage container 80 and an operative portion 98, shown here as a propeller-type element, extending within the storage container. Manual movement of handle portion 96, when attached, causes mixing of the contents of storage container 80. In one preferred option, mixer element 94 is mounted to allow axial movement between the positions shown in FIGS. 5C and 5D. This provides a push-action release mechanism for breaking barrier 84 to release the composition into dispensing container 12.

Figure 5A:
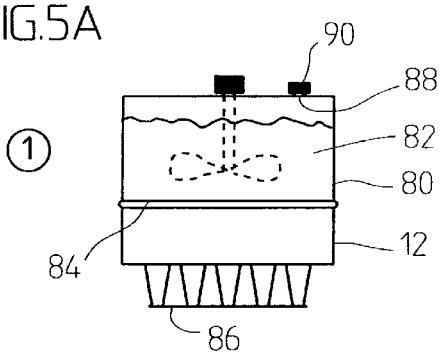
FIGS. 5A–5G are a sequence of schematic side views of the hair dye dispenser of FIG. 1 showing the structure and use of a first type of storage container in preparing the hair dye dispenser for use.
Figure 5B:
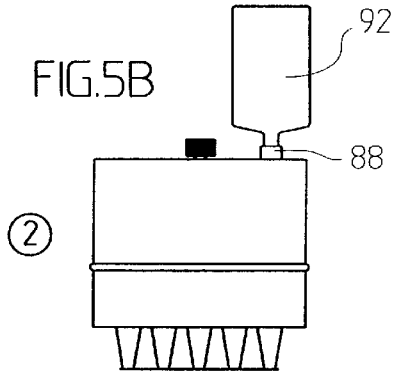
Figure 5C:
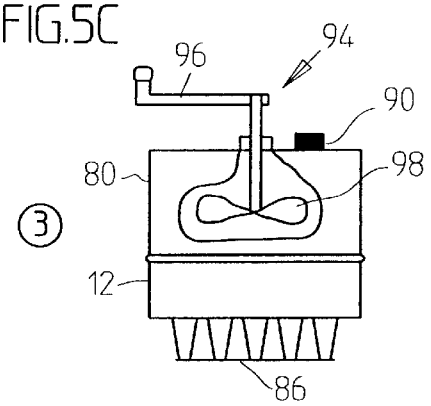
Figure 5D:
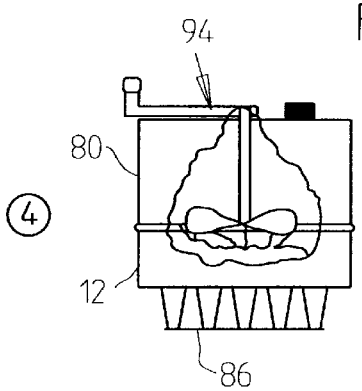
Figure 5E:
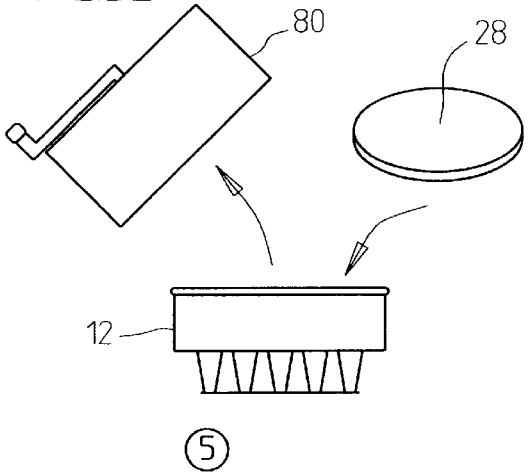
Figure 5F:
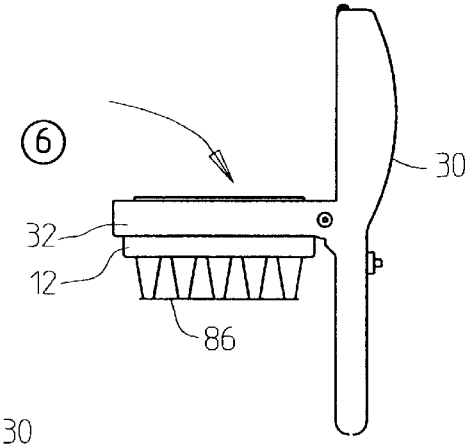
Figure 5G:
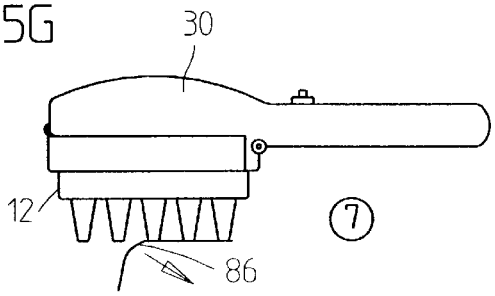

Once the mixed composition has drained into dispensing container 12, storage container 80 is disconnected from dispensing container 12 and piston 28 is placed in position (FIG. 5E). Socket 32 of housing 30 is then opened, typically about a hinge 100 as shown (FIG. 5F), to receive dispensing container 12. Housing 30 may then be closed and sealing sheet 86 pealed off to render dispenser 10 ready for use.

Figure 6A:
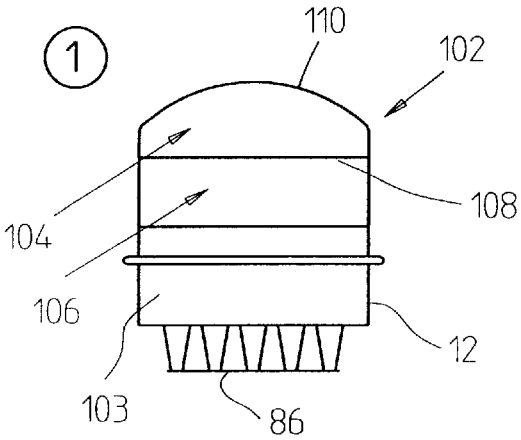
FIGS. 6A–6D are a sequence of schematic side views parallel to FIGS. 5A–5D showing the structure and use of a second type of storage container.
Figure 6B:
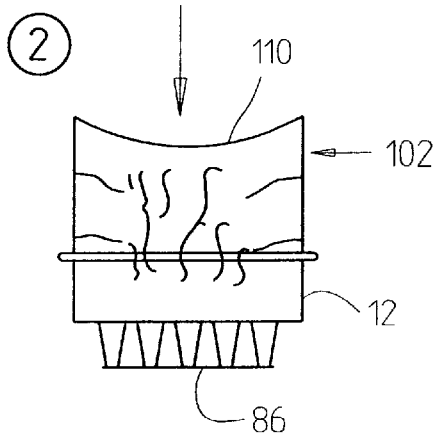
Figure 6C:
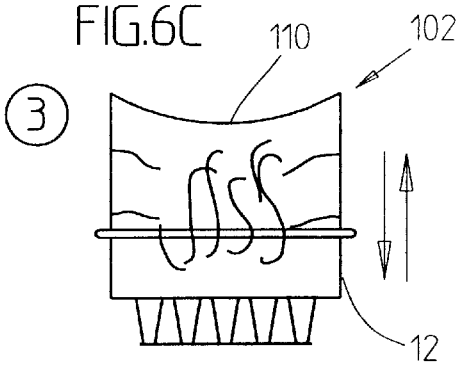
Figure 6D:
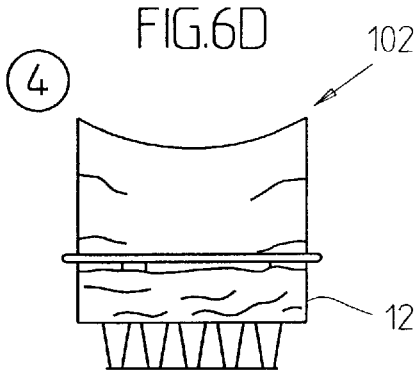

Turning now briefly to FIGS. 6A–6D, these show an alternative two-compartment implementation of a storage container 102. In this case, in addition to an external breakable barrier 103, two components of the hair dye are stored separately in compartments 104 and 106 separated by a second breakable barrier 108. Preferably, an outer wall 110 of storage container 102 is designed so as to be flexible. This structure is such that, when both compartments 104 and 106 are substantially full of hair dye components, pressure applied to flexible outer wall 110 causes breakable barrier 108, and typically also barrier 103 to be broken (FIG. 6B). The components are then mixed by shaking (FIG. 6C) and allowed to drain down into dispensing container (FIG. 6D). The remaining steps of assembly of dispenser 10 are analogous to those described with reference to FIGS. 5E–5G above.

Figure 7:
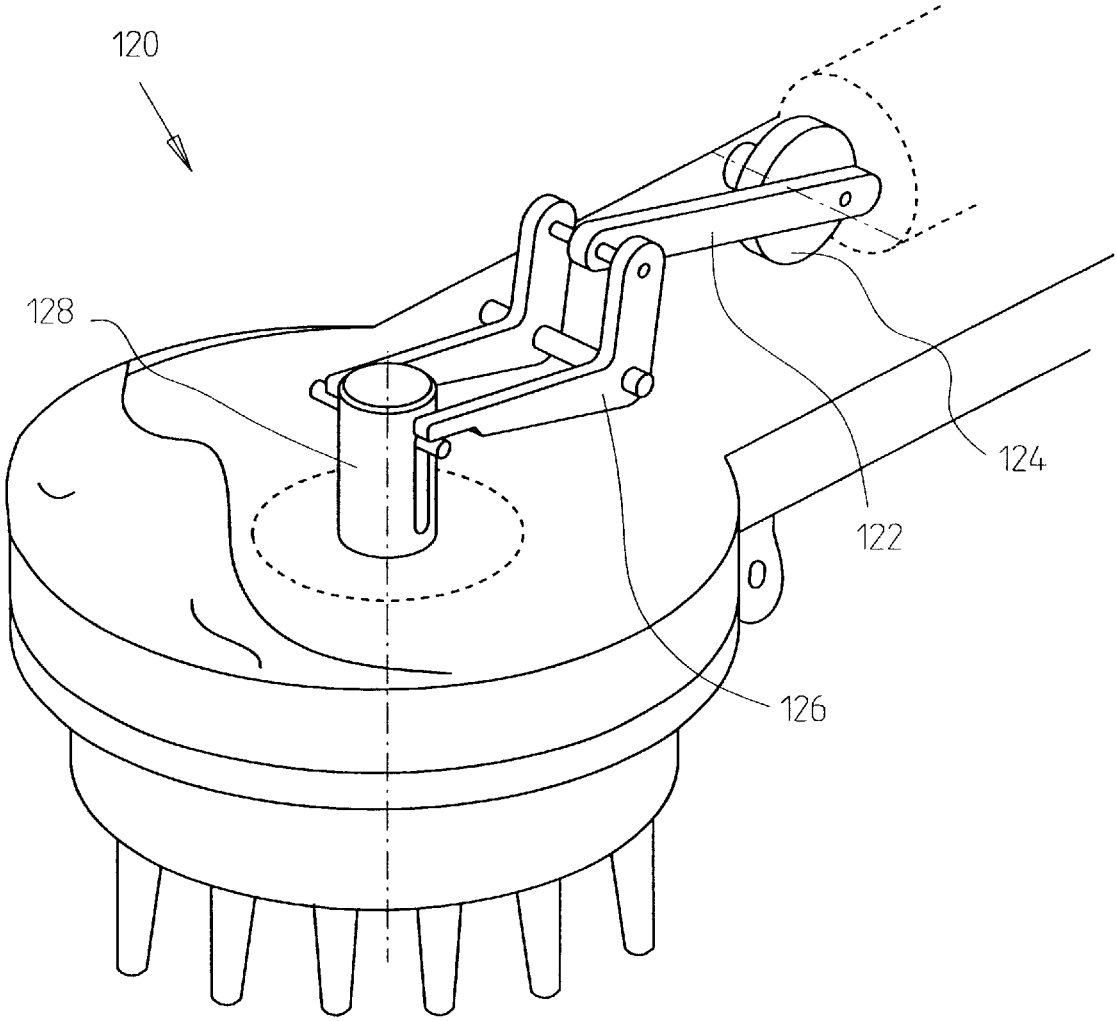
FIG. 7 is a schematic, partially cut-away, isometric view of a first alternative embodiment of a hair dye dispenser, constructed and operative according to the teachings of the present invention, showing a first alternative conversion mechanism.
Figure 8:
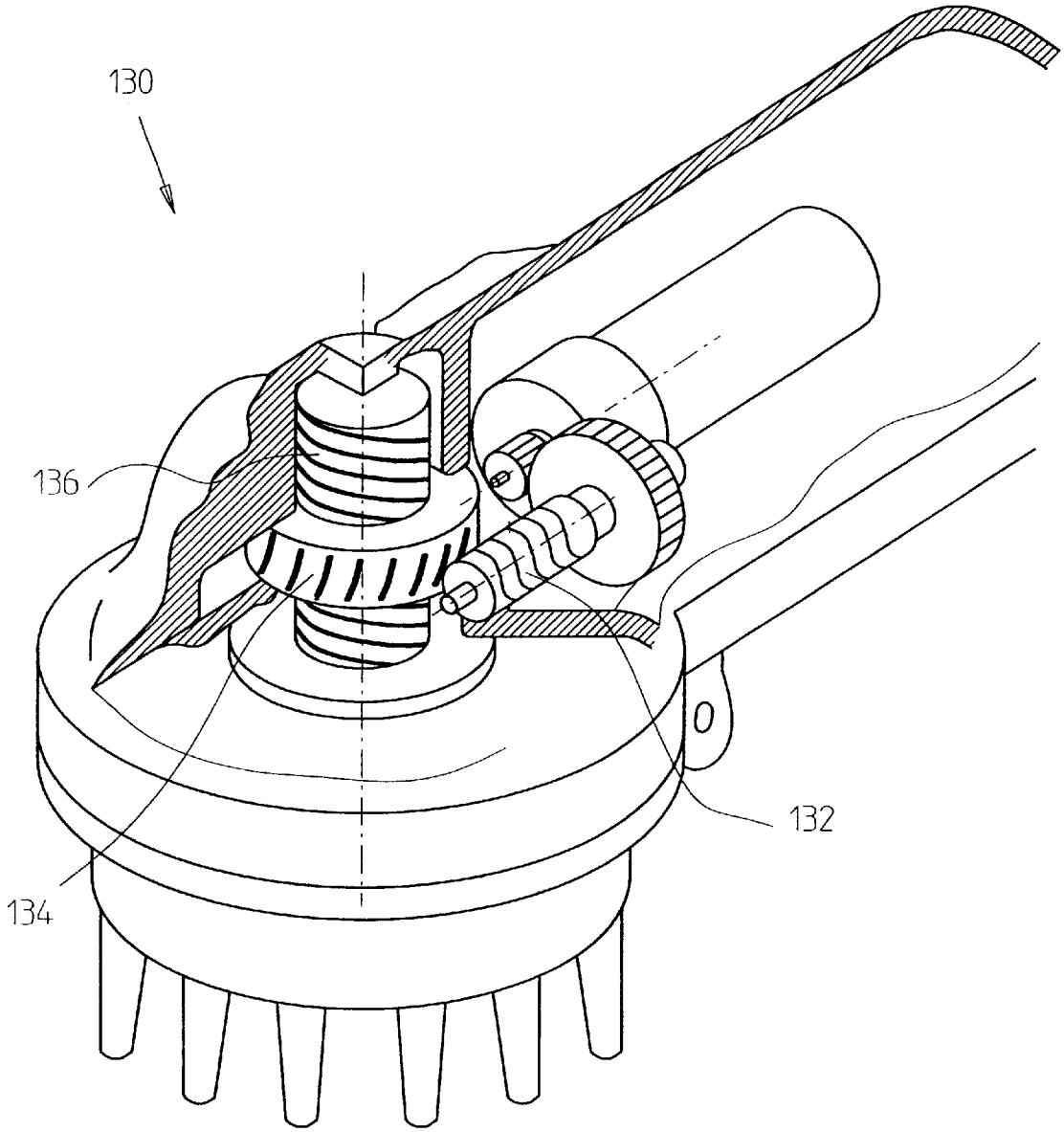
FIG. 8 is a schematic, partially cut-away, isometric view of a second alternative embodiment of a hair dye dispenser, constructed and operative according to the teachings of the present invention, showing a second alternative conversion mechanism.
Figure 9:
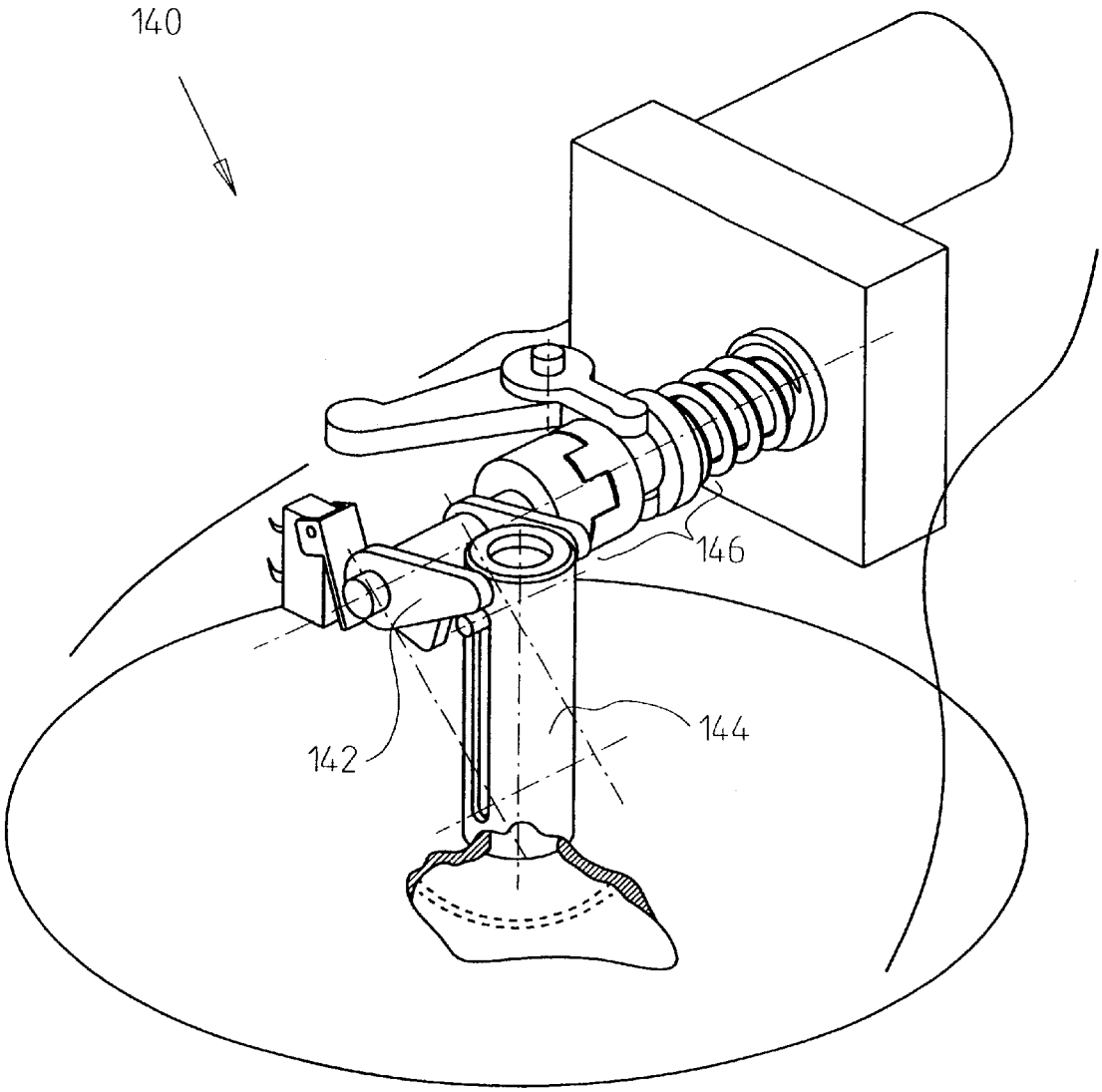
FIG. 9 is a schematic, partially cut-away, isometric view of a third alternative embodiment of a hair dye dispenser, constructed and operative according to the teachings of the present invention, showing a third alternative conversion mechanism.

Finally, turning briefly to FIGS. 7–9, it should be appreciated that conversion mechanism 36 described above is one preferred example selected from a large number of possible embodiments of a conversion mechanism according to the present invention. Three further non-limiting examples of possible conversion mechanisms are illustrated in FIGS. 7–9.

FIG. 7 shows a first alternative conversion mechanism 120 employing a straight-forward drive-rod linkage 122 between a rotating wheel 124 and a lever-arm 126 acting on piston 28. To ensure linear movement, a linear bearing 128 is preferably provided.

FIG. 8 shows a second alternative conversion mechanism 130 in which rotational input is converted to linear displacement through an adjustment bolt mechanism. Specifically, a worm gear 132 drives an internally threaded annular gear 134 which is engaged on a bolt 136. In this case, the actuation mechanism is driven in reverse at the end of each use to return it to its starting position.

Lastly, FIG. 9 shows a third alternative conversion mechanism 140 in which a simple rotating lever 142 directly drives a pin set within a linear bearing 144. To avoid the need to run the actuation mechanism in reverse, a manual clutch arrangement 146 is provided. Clutch arrangement 146 is configured to allow disengagement of lever 142 from the gear mechanism such that the lever returns under the action of a spring (not shown) to its initial position. The clutch arrangement is preferably configured to allow re-meshing at intervals of 90° which correspond to the angle between the final and initial positions of lever 142.

It will be appreciated that the above descriptions are intended only to serve as examples, and that many other embodiments are possible within the spirit and the scope of the present invention.

What is claimed is:

1. A hair dye dispenser for dispensing a fluid hair dye, the dispenser comprising:

(a) a dispensing container for containing and dispensing the hair dye, said dispensing container having a base and at least one side wall sealingly attached to or integrally formed with said base so as to define an internal volume of said dispensing container, said base being formed with an upper surface which is substantially flat and with a lower surface which is formed with a plurality of projecting tines, at least one dispensing aperture being formed through said base;

(b) a piston configured to fit closely in sliding abutment with said at least one side wall so as to be sealingly slidable towards said base;

(c) a housing formed with a socket, said socket being configured for removably receiving said dispensing container; and (d) an actuation mechanism associated with said housing, said actuation mechanism being configured to displace said piston towards said base, thereby dispensing the hair dye through said at least one dispensing aperture.

2. The hair dye dispenser of claim 1, wherein said actuation mechanism includes a conversion mechanism for converting a unidirectional rotational input to a reciprocating linear displacement, said conversion mechanism being configured such that, for a given rate of rotation of said rotational input, a speed of said reciprocating linear displacement is asymmetric, motion in a first direction being at least one order of magnitude slower than motion in an opposite direction.

3. The hair dye dispenser of claim 2, wherein said conversion mechanism includes a ratchet-toothed collar, and a tracer collar mounted coaxially with, and rotatable relative to, said ratchet-toothed collar such that relative rotation of said tracer collar relative to said ratchet-toothed collar generates said asymmetric reciprocating linear movement in an axial direction.

4. The hair dye dispenser of claim 3, wherein said ratchet-toothed collar features at least three ratchet teeth.

5. The hair dye dispenser of claim 3, wherein said tracer collar features ratchet-teeth so as to complement said ratchet-toothed collar.

6. The hair dye dispenser of claim 2, wherein said actuation mechanism further includes an electric motor connected so as to provide said rotational input.

7. The hair dye dispenser of claim 6, wherein said actuation mechanism further includes a sensor deployed to provide an end-of-cycle output indicative of said conversion mechanism reaching a predefined point in the cycle of said reciprocating linear displacement, said actuation mechanism being responsive to said end-of-cycle output to interrupt operation of said motor.

8. The hair dye dispenser of claim 6, wherein said electric motor is connected to said conversion mechanism through a gear mechanism, said gear mechanism being configured to reduce an output speed of said motor by a ratio of at least about 100:1.

9. The hair dye dispenser of claim 7, wherein said gear mechanism is configured to reduce an output magnitude of said motor by a ratio of at least about 1000:1.

10. The hair dye dispenser of claim 1, wherein said dispensing container has a length measured along a major dimension of said base and a height measured along said at least one side wall perpendicular to said length, said length being at least about twice said height.

11. The hair dye dispenser of claim 1, wherein said at least one dispensing aperture is implemented as a dispensing channel along one of said projecting tines.

12. The hair dye dispenser of claim 1, wherein said at least one dispensing aperture is implemented as a plurality of dispensing apertures distributed substantially around the periphery of said base.

13. The hair dye dispenser of claim 1, wherein said housing is formed with a handle configured to be held in a hand of a user, said handle having an internal volume and a virtual direction of elongation, and wherein said socket is configured to define an inserted position of said dispensing container in which said base is substantially parallel to said virtual direction of elongation.

14. The hair dye dispenser of claim 1, further comprising a storage container configured for storing at least one component of the hair dye in a sealed manner, said storage container being configured for removable attachment to said dispensing container in a manner to allow release of the at least one component from said storage container into said dispensing container.

15. The hair dye dispenser of claim 14, wherein said storage container is formed with a breakable barrier to facilitate releasing of the at least one component from said storage container into said dispensing container.

16. The hair dye dispenser of claim 14, wherein said storage container is formed with two compartments for storing two components of the hair dye separately, said two compartments being separated by a breakable barrier to facilitate mixing of the components prior to use.

17. The hair dye dispenser of claim 16, wherein said storage container features a flexible outer wall configured such that pressure applied to said flexible outer wall breaks said breakable barrier.

18. The hair dye dispenser of claim 14, further comprising a storage bottle for storing an additional component of the hair dye, said storage container having a connection port configured to receive said storage bottle for mixing of the hair dye components.

19. The hair dye dispenser of claim 14, further comprising a mixer element associated with said storage container, said mixer element having a handle portion extending from the exterior of said storage container and an operative portion extending within said storage container so that manual movement of said handle portion causes mixing of the contents of said storage container.

20. A hair dye dispenser for dispensing a fluid hair dye, the dispenser comprising:

(a) a dispensing container for containing and dispensing the hair dye, said dispensing container having a base and at least one side wall sealingly attached to or integrally formed with said base so as to define an internal volume of said dispensing container, said base being formed with an upper surface which is substantially flat and with a lower surface which is formed with a plurality of projecting tines, at least one dispensing aperture being formed through said base;

(b) a piston configured to fit closely in sliding abutment with said at least one side wall so as to be sealingly slidable towards said base; and (c) an actuation mechanism associated with said dispensing container and said housing, said actuation mechanism being configured to displace said piston towards said base, thereby dispensing the hair dye through said at least one dispensing aperture, wherein said actuation mechanism includes a conversion mechanism for converting a unidirectional rotational input to a reciprocating linear displacement, said conversion mechanism being configured such that, for a given rate of rotation of said rotational input, a speed of said reciprocating linear displacement is asymmetric, motion in a first direction being at least one order of magnitude slower than motion in an opposite direction.

* * * * *